United States Patent [19]

Komatsu

[11] 3,986,225

[45] Oct. 19, 1976

[54] MOP HOLDER

[75] Inventor: Toshiyoshi Komatsu, Osaka, Japan

[73] Assignee: Duskin Franchise Co. Ltd., Osaka, Japan

[22] Filed: Sept. 2, 1975

[21] Appl. No.: 609,518

[52] U.S. Cl. ..... 15/147 A; 15/229 BP

[51] Int. Cl.[2] ..... A47L 13/252

[58] Field of Search ..... 15/144 A, 147, 148, 15/149, 228, 229 A, 229 AP, 229 AC, 229 AW, 229 B, 229 BP, 229 BC, 229 BW, 233

[56] References Cited

UNITED STATES PATENTS

| | | | |
|---|---|---|---|
| 1,550,845 | 8/1925 | Rickards | 15/229 BP X |
| 2,996,745 | 8/1961 | Ballinger | 15/229 BP |
| 3,362,037 | 1/1968 | Griffin | 15/229 B |

FOREIGN PATENTS OR APPLICATIONS

| | | | |
|---|---|---|---|
| 1,267,092 | 6/1961 | France | 15/229 BP |
| 194,901 | 3/1923 | United Kingdom | 15/228 |

*Primary Examiner*—Daniel Blum
*Attorney, Agent, or Firm*—Sherman & Shalloway

[57] ABSTRACT

A mop holder comprising, in combination, a frame assembly comprising a longitudinal sheet metal frame, a pair of metallic wire frames and clamp members for connecting said sheet metal frame with said metallic wire frames, each of said metallic wire frames having a longitudinal outer leg, a pair of longitudinal inner legs connected to said outer leg through cornered ends respectively, and a pair of transverse legs connected to said inner legs respectively, said outer leg being outwardly convexed and elongated beyond said sheet metal frame, said metallic wire frames being arranged symmetrically with respect to a horizontal, longitudinal axis of said sheet metal frame so that the pair of inner legs of the first metallic wire frame and the pair of inner legs of the second metallic wire frame face each other with a small distance therebetween, and said clamp members being formed by curling edges of said sheet metal frame around the transverse legs of the metallic wire frames; and a pair of spaced standards extending upwardly from said sheet metal frame for receiving a universal handle coupling.

6 Claims, 6 Drawing Figures

MOP HOLDER

This invention relates to a mop holder and more particularly, the invention relates to a mop holder in which attachment of a mop to a frame of the holder can be accomplished relatively easily and the mop is held to the frame of the holder securely during cleaning operations. Further, the invention relates to a mop holder which has a relatively simple yet durable and long lasting structure.

Mop holders, heretofore employed, comprise, in general, a frame made from a metal wire or a metal sheet, a mop handle or shaft, and a universal pivot or swivel connection for connecting said handle or shaft to the frame. Known mop holders of this type are satisfactory in the point that the angle of contact of the handle or shaft with a floor face to be cleaned can freely be adjusted, but few of them satisfy simultaneously the requirements of a simple structure and a good durability or of easiness in attachment and dismounting of the mop and secure holding of the mop during cleaning operation.

It is therefore a primary object of this invention to provide a mop holder which has a simple structure and can be manufactured with ease and which is durable and can be used for a long time.

Another object of this invention is to provide a mop holder in which operations of attachment and dismounting of a mop can be performed with ease and the coming-off of the mop from the frame during the cleaning operation can be effectively prevented.

In accordance with this invention, there is provided a mop holder comprising, in combination, a frame assembly comprising a longitudinal sheet metal frame, a pair of metallic wire frames and clamp members for connecting said sheet metal frame with said metallic wire frames, each of said metallic wire frames having a longitudinal outer leg, a pair of longitudinal inner legs connected to said outer leg through cornered ends respectively, and a pair of transverse legs connected to said inner legs respectively, said outer leg being outwardly convexed and elongated beyond said sheet metal frame, said metallic wire frames being arranged symmetrically with respect to a horizontal, longitudinal axis of said sheet metal frame so that the pair of inner legs of the first metallic wire frame and the pair of inner legs of the second metallic wire frame face each other with a small distance therebetween, and said clamp members being formed by curling edges of said sheet metal frame around the transverse legs of the metallic wire frames; a pair of spaced standards extending upwardly from said sheet metal frame, said standards being formed by punching said sheet metal frame leaving connecting portions between said standards and said sheet metal frame and turning it up out of the plane of said sheet metal frame, each of said standards having a hole therein, and said holes on said standards being aiigned on an axis extending in parallel to the plane of said sheet metal frame; a pivot bracket member having upwardly extending legs and a curled end which forms therein a longitudinal passage to receive a pivot pin which is mounted in the holes of said standards, said legs of said bracket member having transverse holes for receiving a connecting member; a yoke having transverse holes at one end thereof for receiving said connecting member and being pivotally connected with said bracket member by means of said connecting member; and a mop handle rigidly attached to the other end of said yoke.

This invention will now be described in detail by reference to the accompanying drawings, in which.

Figure 1:
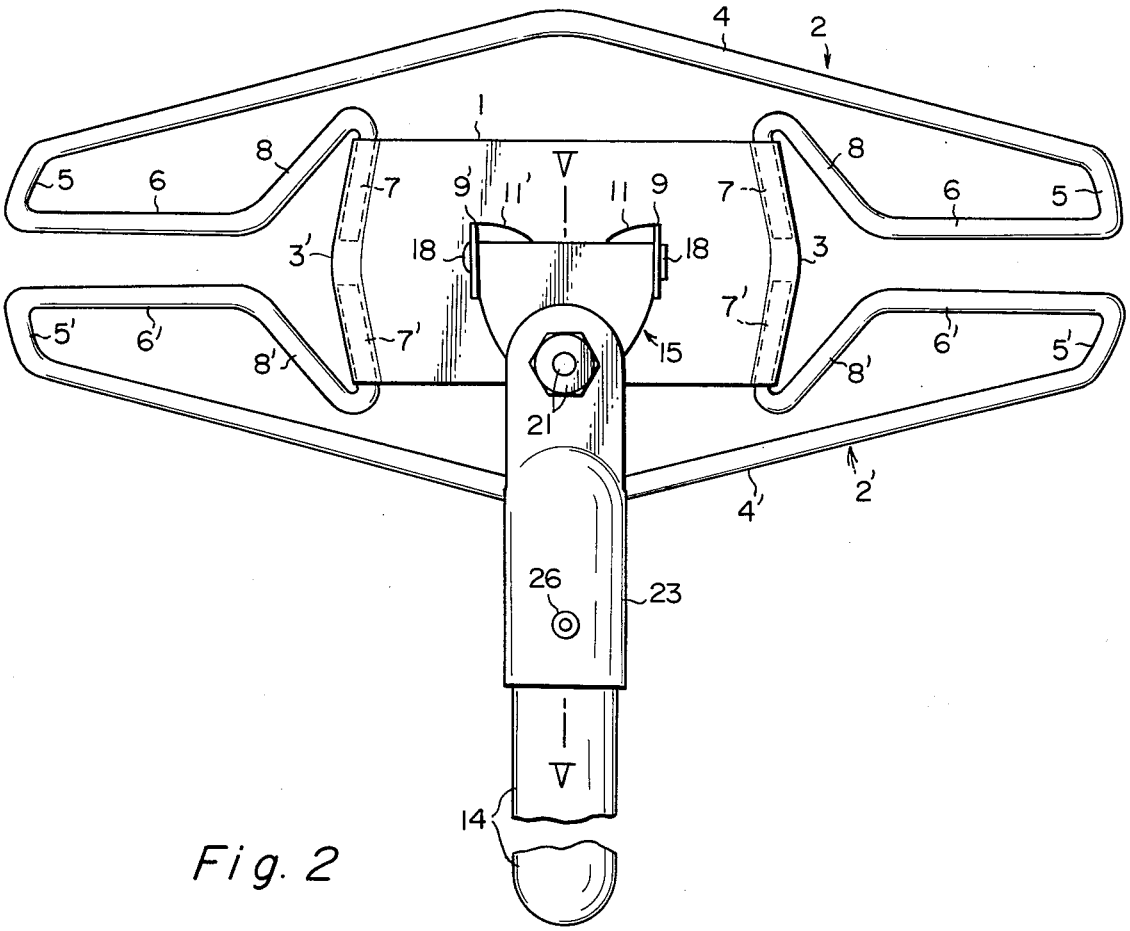
FIG. 1 is a plan view illustrating the entire structure of the mop holder of this invention.

In this invention, a frame assembly for attachment of a dust mop, comprises a sheet metal frame which is inclusively indicated by reference numeral 1, a pair of metallic wire frames 2 and 2', and clamp members 3 and 3' for connecting said sheet metal frame with said metallic wire frames. Each of the metallic wire frames 2 and 2' is formed by bending a metallic wire having a diameter of, for example, 3 to 6 mm and includes an outer leg 4 or 4' extending substantially longitudinally, a pair of inner legs 6 or 6' extending longitudinally and connected to said outer leg 4 or 4' through cornered ends 5 or 5', and a pair of transverse legs 7 or 7' connected to said inner legs 6 or 6'. All of these legs are located in one horizontal plane.

Figure 2:
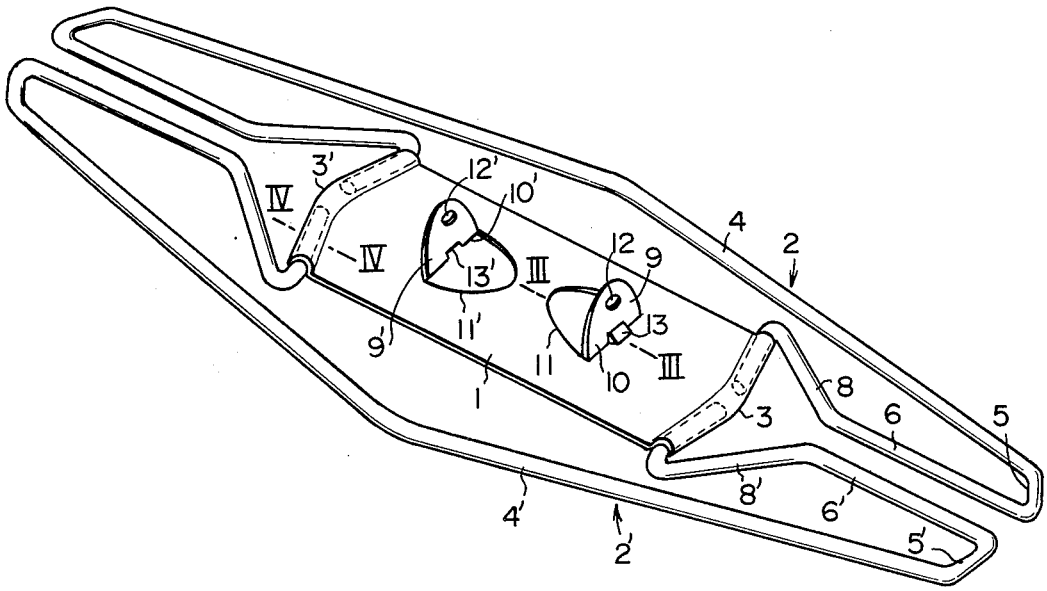
FIG. 2 is a perspective view showing the frame assembly of the mop holder of this invention.
Figure 3:
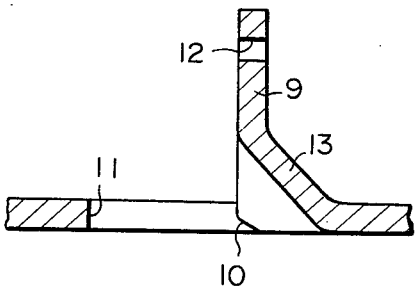
FIG. 3 is an enlarged sectional view showing, in the section taken along the line III—III in FIG. 2, the standard of the frame assembly shown in FIG. 2.

As clearly illustrated in FIGS. 1 and 2, a pair of metallic wire frames 2 and 2' are arranged symmetrically with respect to a horizontal, longitudinal axis of the longitudinal sheet metal wire 1 so that the pair of inner legs 6 of the first metallic wire frame 2 and the pair of inner legs 6' of the second metallic wire frame 2' face each other with a small distance therebetween.

Figure 4:
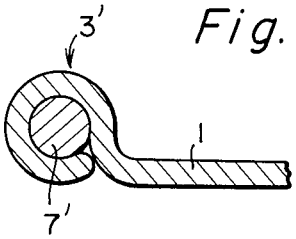
FIG. 4 is an enlarged sectional view showing, in the section taken along the line IV—IV in FIG. 2; the clamp member of the frame assembly shown in FIG. 2.

As is illustrated in FIGS. 1 and 4, the clamp members 3 and 3' for connecting the sheet metal frame 1 with the metallic wire frames 2 and 2' are formed by curling edges of said sheet metal frame 1 around the transverse legs 7 and 7' of the first and second metallic wire frames 2 and 2'. The bottom face of the sheet metal frame 1 is in the same horizontal plane as the horizontal plane where the bottom faces of the metallic wire frames 2 and 2' are present. By virtue of this arrangement, a uniform pressing force can be applied to the entire of the mop to be contacted with a floor face on dusting or polishing.

One of the important features of this invention is that each of the first and second metallic wire frames is formed of the outer legs 4 or 4' and the inner legs 6 or 6' connect to the outer leg 4 or 4' through cornered ends 5 or 5', and a pair of these metallic wires 2 and 2' are arranged symmetrically with respect to a certain axis. By adoption of such structure and arrangement, a force of a spring is given in the transverse direction to both the projecting ends 5 and 5' of each metallic wire frame to contract said pointed ends 5 and 5' in the transverse direction, whereby insertion of a mop into a pocket or dismounting of the mop from the pocket can be greatly facilitated. Further, after the mop has been inserted in the pocket, the pointed ends 5 and 5' are elongated in the transverse direction, whereby the mop can be secured assuredly.

Moreover, in the frame assembly of the mop holder of this invention, respective legs of the metallic wire frames are uniformly distributed in a broad region of the pocket of the mop. By virtue of such structure and arrangement, it is possible to apply a uniform pressing force to the entire surface of the mop. Accordingly, this invention provides a strong frame assembly which can endure violent handling although it is very light in weight.

As is seen from FIGS. 1 and 2, the outer leg 4 or 4' has a length greater than the sheet metal frame, but the length of the inner leg 6 or 6' is considerably shorter than that of the outer leg 4 or 4'. In order to apply a force of the spring readily and easily between the cornered ends 5 and 5', it is important that each of the outer legs 4 and 4' should be outwardly convexed namely it should have a configuration defined by an outwardly convex broken line or an arch-like form. For this purpose, it is preferred that expanded legs 8 and 8' extending obliquely outwardly be disposed between the inner short legs 6 and 6' and the transverse legs 7 and 7', and the expanded legs 8 and 8' be connected with transverse legs 7 and 7', respectively, in a V-shaped manner. Further, in order to prevent completely separation of the metallic wire frames 2 and 2' from the sheet metal frame 1, it is preferred that confronting clamp members 3 and 3' be arranged to form an outwardly tapering angle therebetween.

In the central portion of the sheet metal frame 1, a pair of standards 9 and 9' extending upwardly from the frame 1 are disposed in a prearranged space in a longitudinal direction from each other, and these standards 9 and 9' are formed by punching the sheet metal frame 1 leaving connecting portions 10 and 10' between said frame 1 and standards 9 and 9' and turning up the sheet metal frame 1 out of the plane thereof as shown in FIG. 2. Accordingly, punching holes 11 and 11' are formed on the sheet metal frame 1 in correspondence with the standards 9 and 9'. Holes 12 and 12' are formed on the standards 9 and 9' so that the holes 12 and 12' are aligned on an axis extending in parallel to the plane of said sheet metal frame 1.

In this invention, the standards 9 and 9' are formed by punching and turning-up of the sheet metal frame 1 and hence, they are integrated with the frame 1. In this structure, it is preferred that reinforcing ribs 13 and 13' be disposed on the standards 9 and 9', respectively, so that each of the ribs 13 and 13' is connected to both the frame 1 and the standard 9 or 9' with an angle of about 45°. The reinforcing ribs 13 and 13' are formed, for example, by press-molding central parts of connecting portions 10 and 10' between the sheet metal frame 1 and standards 9 and 9' in preparing the standards 9 and 9' by turning up the punched sheet metal frame 1. Each of the reinforcing ribs 13 and 13' has, in general, a small width of about 2 to about 7 mm. and a length of about 1 to about 7 mm., though such numerical limitation is not particularly critical in this invention. If such reinforcing ribs 13 and 13' are disposed at the central parts of the connecting portions 10 and 10' between the sheet metal frame and the standards, a high resistance to flexural deformation is imparted to each of the standards 9 and 9', and therefore, even if a large force is imposed in the longitudinal direction during dusting or polishing, deformation of the standards can be effectively prevented.

Figure 5:
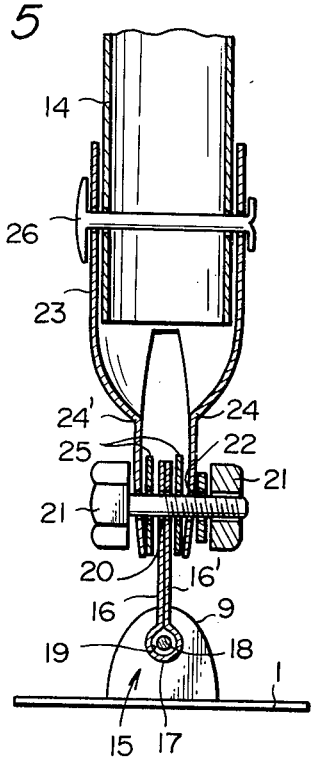
FIG. 5 is an enlarged transversely sectional view showing, in the section taken along the line V—V in FIG. 1, the frame assembly, standards, the bracket member, the yoke and the connecting portion of the handle in the mop holder shown in FIG. 1.

A pivotal bracket member inclusively indicated by reference numeral 15 is pivotally engaged with the pair of the standards 9 and 9' to attain a universal pivotal connection between the above-mentioned frame assembly and a mop shaft 14. As is clearly illustrated in FIGS. 1 and 5, the pivotal bracket member 15 is formed by bending a metal sheet and includes a pair or upwardly extending legs 16 and 16' and a curled end 17 in which there is formed a passage 19 for a pivot pin 18 supported in the holes 12 and 12' of the standards 9 and 9'. In this arrangement, the bracket member 15 is allowed to swing in the transverse direction with the pivot pin 18 as a center.

Through the two legs 16 and 16' of the bracket member 15, a hole 20 is perforated to receive therein a connecting member 21 such as bolt-nut, and a yoke 23 having at forked ends 24 and 24' thereof holes 22 for receiving the connecting member 21 is engaged with the bracket member 15 through this connecting member 21. In order to connect the legs 16 and 16' of the bracket member 15 with the corresponding ends 24 and 24' of the yoke 23 so that they can swing in the longitudinal direction, there are disposed washers 25 between them. The other end portion of the yoke 23 is made hollow and one end of a mop handle 14 is inserted into this hollow portion and the yoke 23 and the mop handle 14 are rigidly connected to each other by a connecting pin 26.

By adopting the foregoing structure and arrangement to the mop holder of this invention, the mop handle 14 is allowed to swing in an optional direction with respect to the frame assembly, as in the case of conventional mop holders.

Figure 6:
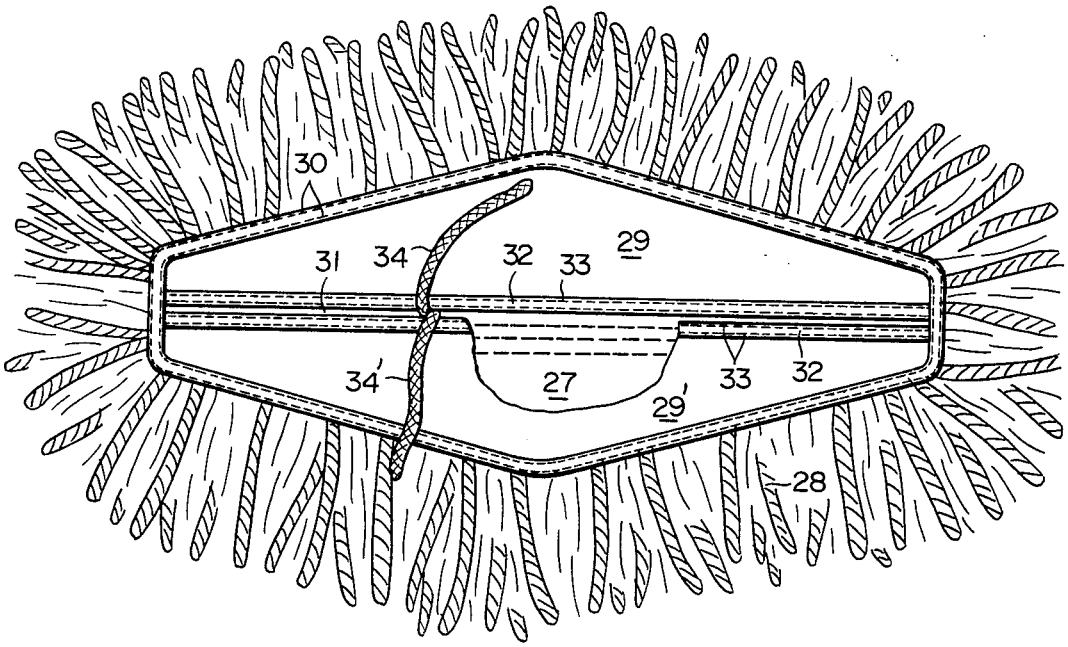
FIG. 6 is a partially sectional plan view illustrating a mop suitable for attachment to the mop holder of this invention.

A mop which is preferably attached to the mop holder of this invention is illustrated in FIG. 6. A bottom sheet 27 composed of a woven fabric, such as canvas, twill or duck carries on one side thereof, a vast number of strands or cords 28, composed of twisted yarns, and a pair of fabric pieces 29 and 29' are secured to the bottom sheet 27 at the marginal edges thereof by stitches 30. The configuration of the bottom sheet 27 is made as rhombic as possible to match the configuration of the frame assembly of the mop holder, and the two fabric pieces 29 and 29' are arranged symmetrically with respect to the longitudinal axis of the bottom sheet 27. Accordingly, a pair of pockets are formed between the fabric pieces 29 and 29' and the bottom sheet 27 through an intervening opening 31 for insertion of the frame assembly. The open end of each of the fabric pieces 29 and 29' is reinforced, as is well known in the art, by a ribbons 32 and stitches 33. Cords 34 and 34' may be fixed to the reverse side of the pair of fabric pieces 29 and 29', respectively, to clamp and secure the mop to the frame of the holder.

A mop cord 28 may be impregnated with a known oil composition for dust control, for example, a composition comprising a mineral oil, a cationic surface active agent, a non-ionic surface active agent and an antifungal agent, so as to perform cleaning operation without use of water for a long time.

In attaching a mop to the mop holder of this invention having the above structure, the first metallic wire frame 2 is inserted into the pocket formed below the fabric piece 29 through the mop-inserting opening 31, and then, the second metallic wire frame 2' is inserted into the pocket formed below the fabric piece 29' by utilizing the spring between the pointed ends 5 and 5'. Since the ends 5' of the second metallic wire frame 2' can be elastically deformed in the transverse direction and the outer leg 4' has a configuration defined by an outwardly convex broken line (bowed configuration), insertion of the metallic wire frame 2' into the pocket can be accomplished very easily. After insertion, the metallic wire frames restore the original normal form, and hence, the mop can be securely held by the frame member.

The mop holder of this invention can be prepared very easily at a low cost merely by the process of bending metallic wire and sheet metal without performing an operation requiring a great deal of labor and expenses, such as soldering. Further, although the structure of the mop holder of this invention is very simple, it has a strength sufficient to endure long-time use and violent handling.

What I claim is:

1. In a mop holder, the combination of a frame assembly comprising a longitudinal sheet metal frame, a pair of metallic wire frames and clamp members for connecting said sheet metal frame with said metallic wire frames, each of said metallic wire frames having a longitudinal outer leg, a pair of longitudinal inner legs connected to said outer leg through cornered ends respectively, and a pair of transverse inwardly extending legs connected to said inner legs respectively, said outer leg being outwardly convexed and elongated beyond said sheet metal frame, said metallic wire frames being arranged symmetrically with respect to a horizontal, longitudinal axis of said sheet metal frame so that the pair of inner legs of the first metallic wire frame and the pair of inner legs of the second metallic wire frame face each other with a small distance therebetween, and said clamp members being formed by curling edges of said sheet metal frame around the transverse legs of the metallic wire frames; a pair of spaced standards extending upwardly from said sheet metal frame, said standards being formed by punching said sheet metal frame leaving connecting portions between said standards and said sheet metal frame and turning it up out of the plane of said sheet metal frame, each of said standards having a hole therein, and said holes on said standards being aligned on an axis extending in parallel to the plane of said sheet metal frame; a pivot bracket member having upwardly extending legs and a curled end which forms therein a longitudinal passage to receive a pivot pin which is mounted in the holes of said standards, said legs of said bracket member having transverse holes receiving a connecting member; a yoke having transverse holes at one end thereof receiving said connecting member and being pivotally connected with said bracket member by means of said connecting member; and a mop handle rigidly attached to the other end of said yoke.

2. A mop holder as set forth in claim 1 wherein the outer legs of the first and second metallic wire frames are arranged to have a substantially rhombic shape.

3. A mop holder as set forth in claim 1 wherein inner legs and transverse legs of each metallic wire frame are connected with each other through expanded legs extending obliquely outwardly, and said expanded legs and transverse legs are connected with each other in a V-shaped manner.

4. A mop holder as set forth in claim 1 wherein said clamp members formed on both the ends of the sheet metal frame are arranged to form an outwardly tapering angle therebetween.

5. A mop holder as set forth in claim 1 wherein reinforcing ribs are disposed on said pair of standards, respectively, so that the ribs are connected to the sheet metal frame and said standards, respectively, at an angle of about 45°.

6. A mop holder as set forth in claim 5 wherein said reinforcing ribs are formed by press-molding central parts of connecting portions between the sheet metal frame and the standards.

* * * * *